US005146235A

United States Patent [19]

Frese

[11] Patent Number: 5,146,235

[45] Date of Patent: Sep. 8, 1992

[54] HELICAL UHF TRANSMITTING AND/OR RECEIVING ANTENNA

[75] Inventor: Stefan Frese, Bockfliess, Austria

[73] Assignee: AKG Akustische u. Kino-Geräte Gesellschaft m.b.H., Vienna, Austria

[21] Appl. No.: 627,036

[22] Filed: Dec. 13, 1990

[30] Foreign Application Priority Data

Dec. 18, 1989 [AT] Austria ..... 2871/89

[51] Int. Cl.[5] ..... H01Q 1/36

[52] U.S. Cl. ..... 343/895; 343/872

[58] Field of Search ..... 343/895, 711, 712, 713, 343/872

[56] References Cited

U.S. PATENT DOCUMENTS

| | | | |
|---|---|---|---|
| 2,993,204 | 7/1961 | Macalpine | 343/895 |
| 3,510,872 | 5/1970 | Mullaney | 343/895 |
| 3,524,193 | 8/1970 | Auletta | 343/895 |
| 3,699,585 | 10/1972 | Morrison | 343/895 |
| 3,737,912 | 6/1973 | Cribb | 343/895 |
| 3,836,979 | 9/1974 | Kurland et al. | 343/895 |
| 4,068,238 | 1/1978 | Acker | 343/895 |
| 4,087,820 | 5/1978 | Henderson | 343/895 |
| 4,169,267 | 9/1979 | Wong et al. | 343/895 |
| 4,214,246 | 7/1980 | Arechavala | 343/900 |
| 4,427,984 | 1/1984 | Anderson | 343/895 |
| 4,442,438 | 4/1984 | Siwiak et al. | 343/895 |
| 4,475,111 | 10/1984 | Gittinger et al. | 343/895 |
| 4,495,503 | 1/1985 | Morman | 343/895 |
| 4,935,747 | 6/1990 | Yuichi et al. | 343/895 |

OTHER PUBLICATIONS

"Antennas" by John D. Kraus, Ph. D., McGraw Hill Book Company, 1950, chapter 7, pp. 173-216.

*Primary Examiner*—Michael C. Wimer
*Assistant Examiner*—Hoanganh Le
*Attorney, Agent, or Firm*—Anderson Kill Olick

[57] ABSTRACT

A helical UHF transmitting and/or receiving antenna for electromagnetic waves in the frequency range of between 400 MHz and 1000 MHz. The helical antenna is arranged within a closed housing which is permeable to HF radiation. The UHF signal is supplied to an end of the helical antenna through a coaxial connector. The helix of the antenna has at least one and a half turns but not more than ten turns. Diameter, height and total length of the antenna wire are very small in comparison to the wave length. A mechanically-operated device permits a continuous change of the height of the antenna helix in axial direction thereof or of the diameter transversely of the antenna axis.

2 Claims, 2 Drawing Sheets

HELICAL UHF TRANSMITTING AND/OR RECEIVING ANTENNA

BACKGROUND OF THE INVENTION

1. Field of the Invention

The present invention relates to a UHF transmitting and/or receiving antenna in the form of a helical antenna for electromagnetic waves in the frequency range of between 400 MHz and 1000 MHz. The helical antenna is arranged within a closed housing which is permeable to HF radiation. The UHF signal is supplied to an end of the helical antenna through a coaxial connector. The helix of the antenna has at least one and a half turns but not more than ten turns. Diameter, height and total length of the stretched-out wire are very small in comparison to the wave length. A mechanically operated device permits a continuous change of the height of the antenna helix along the axis thereof.

2. Description of the Related Art

Helical antennas of the above-described type are known and are described, for example, in the book "Antennas" by John D. Kraus, McGraw Hill Book Company, 1950, chapter 7, pages 173 to 216. When the geometric dimensions of the antenna, primarily the length of the turns, remain small as compared to the wave lengths, the state of radiation of the helical antenna in the distant field is equal to that of a dipole antenna. The direction of maximum radiation of the antenna extends in the distant field in a plane extending perpendicularly to the helix axis, so that the helical antenna operates as an omnidirectional antenna with the axis of the helix as the axis of symmetry. The distant field of such a helical antenna is an elliptic field which becomes a circularly polarized field under the condition $$D = \frac{1}{\pi} \sqrt{2s\lambda}$$

wherein D is the diameter of the helix and s is the pitch of the turns of the helix.

Compared to a $\lambda/4$ dipole antenna, the helical antenna provides the advantage that it can be of geometrically smaller size for radiating the same wave length without losing substantial transmission power as compared to a rod antenna. For example, the structural height of a helical antenna can be reduced to 20% as compared to a $\lambda/4$ dipole antenna, while maintaining an efficiency of 80% of the $\lambda/4$ dipole antenna. Since the helical antenna naturally has a high input resistance, accommodating connections, as they are usually required when the height of dipole antennas is reduced, are not necessary.

However, the helical antenna has the disadvantage that it has only a very small band width, for example, $\pm 1.5\%$ of the transmission frequency, which makes it impossible to use the antenna as an individual antenna in a wide frequency band. The attempt to expand the band width of the transmission frequency by tuning with an adjustable series capacity is not very successful because the tuning range is usually not greater than 5% and because the series capacity additionally leads to an accommodation error. In specific cases, another disadvantage is the fact that stray capacitances, such as, a hand or another part of a human body can act near the antenna, and the previously carried out tuning of the antenna becomes ineffective or the antenna is mistuned.

Helical antennas whose lengths are techanically adjustable are well known from U.S. Pat. No. 3,524,193; 3,510,872; 4,475,111; 3,699,585; 3,836,979; and 4,068,238. However, these antennas are exclusively those which are foldable, collapsable or telescoping and in which the reduction or increase of the height is only carried out to be able to better transport them.

A tunable antenna is known from U.S. Pat. No. 4,214,246 in which electric sliding contacts short-circuit one or more turns of an antenna coil in order to tune the antenna. In this case, either the coil itself serves as an antenna or as a tuning element for an antenna rod connected in series with the coil. The primary advantage of such an antenna arrangement is the fact that remote-controlled continuous tuning of the antenna can be carried out.

U.S. Pat. No. 4,169,267 describes a wide-band helical antenna whose optimum antenna gain is to be in the frequency band of from 773 MHz to 1067 MHz. This requirement is met by constructing the helix of the entire antenna from individual sections, wherein the individual cylindrical helically-shaped sections have different lengths and different diameters and are provided with conically extending transition pieces also in the shape of a helix. The specific arrangement of the individual sections makes possible the optimum adjustment to the required frequency band, to the antenna gain, the directional pattern etc. However, an antenna constructed in this manner will require a substantial amount of space which is not to be underestimated.

Another antenna known from U.S. Pat. No. 4,087,820 is intended, for example, for the short wave range between 2 MHz and 32 MHz. The antenna height is, for example, 35 feet, wherein a movable part of the helix permits the continuous change of the height with the pitch remaining constant, so that the antenna can be tuned to resonance in a very wide frequency range. The disadvantage of this antenna is primarily the extremely large height and comparison to the wave length and the fact that it is relatively difficult to transport because the tubular antenna housing which receives the antenna cannot be reduced in size.

SUMMARY OF THE INVENTION

It is the object of the present invention to provide a helical antenna which can be tuned with very simple means, so that tuning of the helical antenna can be carried out in a frequency band which is as wide as possible.

In a helical antenna of the above-described type, the present invention provides that the continuous change of the antenna height is at most a third of its total height. The continuous height change of the helix is carried out by means of a cap-shaped trimming disk which is provided with a fine thread and is rotatable on a rod which is also provided with a fine thread. The rod is mounted in the axis of the helix and the trimming disk is movable in axial direction of the rod. Instead of the height of the antenna helix, it is also possible to continuously change the diameter of the antenna helix transversely of the axis thereof. The change of the diameter is effected by means of a wing nut which is rotatable on a rod and is rigidly connected to the trimming disk and moves the trimming disk and is lockable by means of a detent against the torsion force of the helix, wherein the helix is held with its end by soldering in solder sleeves of a base plate and the trimming disk. The trimming disk and the rods are made of high-grade HF insulating material.

Practical tests have shown that in the first approximation, the height of the antenna helix and, thus, the pitch of the helix, but also the diameter, influence the resonant frequency of the antenna. As the following formula for the conductance of the helix shows, the height of the antenna helix is inversely proportional to the inductance, while the diameter is directly proportional to the inductance.

$$L = \frac{(ND)^2}{25.4\,(18D + 40H)}$$

In the above formula, D=helix diameter, H=helix height and N=number of turns.

If a resiliently constructed helix is compressed, the height and the pitch are reduced which leads to a reduction in the resonant frequency of the helical antenna. Tuning of an antenna to resonance is necessary for reasons of optimum adjustment. The continuous adjustment of the height or of the diameter of the helical antenna leads to a continuous tuning capability within a frequency band, without having to use separate structural components for this purpose, wherein the greatest possible and smallest possible height and diameter of the helix determine the band limits.

The present invention provides the significant advantage compared to the prior art that, in the relatively wide frequency band of from 400 MHz to 1000 MHz, any transmitting and receiving frequency can be adjusted extremely finely with a set of three tunable helical antennas. It is not necessary to provide a plurality of individual, separately tuned antennas.

Advantageously, a given frequency range will be divided, so that the respectively higher range is 1.3 times the range of the previous range. This leads to a division into three partial bands, wherein the helical antenna used in each partial band permits a tuning capability of about 30%. This leads to three antenna arrangements, wherein the number of helix turns are staggered in the ratio of 1:3.

When the helical antenna according to the present invention is used for movable transmitter microphones in the UHF range, the particular advantage is that because the antenna is small it can be easily mounted at the rearward end of the microphone shaft and, therefore, does not represent an obstruction in practical operation and is also optically almost unnoticeable as compared to a $\lambda/4$ rod antenna.

In the above-mentioned frequency bands, the length of a $\lambda/4$ rod antenna would be 7.5 cm to 15 cm, while the helical antenna according to the present invention with a diameter of approximately 1 cm has a maximum height of also only 1 cm. On the other hand, if the length of the rod antenna were to be shortened, which is also conceivable and possible, the rod antenna would require an additional inductance which would lead to a significant quality loss of the rod antenna. As mentioned above, even though the helical antenna according to the present invention is small, compared to a $\lambda/4$ dipole antenna it still has an efficiency of 80% which is maintained in spite of tuning.

The simplest and technically most elegant solution for carrying out the compression of the resilient helical antenna is to axially move a trimming disk provided with a thread by rotating the trimming disk on a rod which is provided with a fine thread. When the trimming disk is rotated, the pressure acting on the uppermost turn of the antenna leads to a continuous change of the height and pitch of the helical antenna and, depending on the fineness of the pitch of the thread of the rod, a corresponding continuous fine adjustment of the antenna is achieved.

It is apparent that the trimming disk and the rod with the fine thread must be made of high-grade HF insulating material.

In accordance with the requirements already mentioned above, the initial height of the helix must be such that the height of the pitch is reduced to a third when the helix is compressed without causing a contact within the turns of the helix. The number of turns of the helix depends on the total length of the helix wire with a predetermined diameter of the helix. The total length of the helix wire is determined by the greatest wave length $\lambda$ to be transmitted, wherein $\lambda$ must remain large relative to the total length.

The transmitting frequency can also be tuned by changing the diameter of the helix. This tuning is not as precise in operation as when tuning the helical antenna by changing the height. However, the tuning by changing the diameter is always advantageous if a frequency adjustment is to be carried out quickly and simply within a coarse range of the frequency band without having to be very accurate.

Another advantage of the adjustment of the diameter is the fact that this adjustment can be easily carried out in those cases in which the continuous adjustment of the antenna height cannot be carried out for reasons of inadequate available space.

It is further useful if the antenna helix is provided at an end thereof with a coaxial plug connection.

When the helical antenna is used for movable transmitter microphones, and particularly for microphones used in stage operations, the microphone must be easily and quickly adaptable to the predetermined frequency within the frequency range in accordance with the given optimum radiation conditions in the HF range on the stage and also in accordance with the transmitting and receiving frequencies permitted for the operation of such microphones by local authorities.

When a given set of factory-tuned antennas is available, the exchange and, thus, the adaptation of such antennas in practical use can be easily carried out without requiring technical operations, particularly by the non-expert, by placing the correct antenna on the microphone shaft.

In accordance with another feature of the present invention, the base plate of the helical antenna is arranged at a distance from the coaxial plug connection by means of a rod-shaped insulator of high-grade HF insulating material and the UHF signal is supplied to the helix through a piece of coaxial cable.

When the helical antenna is used in the operation of transmitter microphones, the antenna is slid onto the rearward end of the microphone shaft. Depending on the design and length of this shaft, when the microphone is held in a hand, the hand itself acts as a stray capacitance on the antenna which leads to mistuning in the frequency and, thus, to poor radiation properties. In order to overcome these problems, the helical antenna itself must be kept at a distance from the end of the microphone shaft. This is advantageously done by means of an electrically conducting antenna rod of appropriate length.

When the influence of the stray capacitance from the hand to the antenna is too great for certain UHF frequencies of the transmission range or for certain embodiments of the microphone shaft, and when the attendant harmful influences are too unbearable, an antenna arranged insulated from the microphone shaft has been found to be particularly problemfree.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DETAILED DESCRIPTION OF THE PREFERRED EMBODIMENTS

Figure 1:
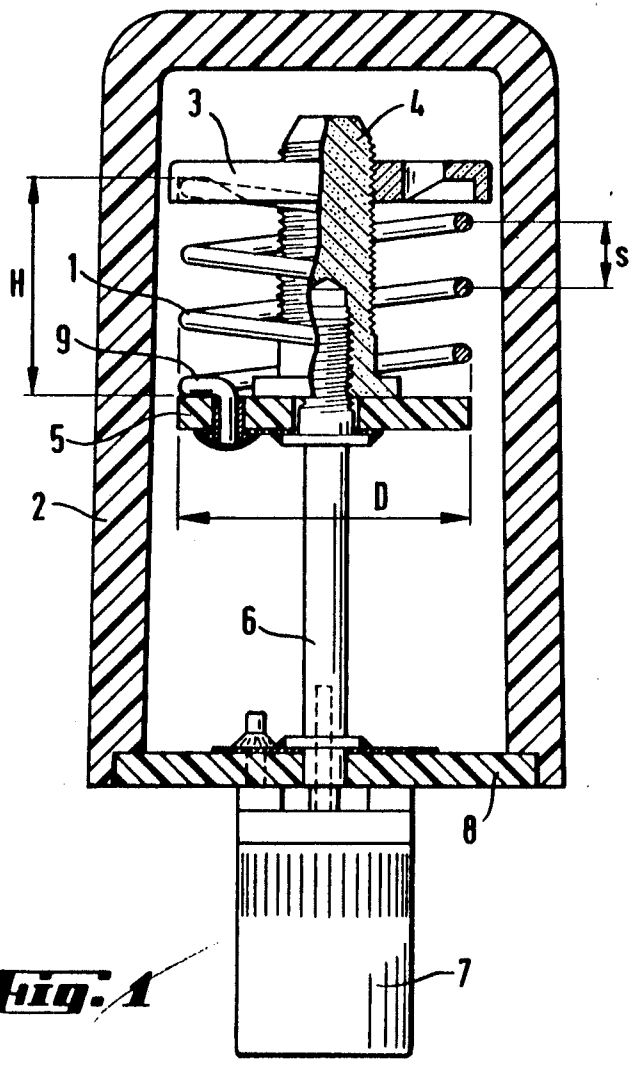
FIG. 1 is a sectional view of a helical antenna according to the present invention.

FIG. 1 of the drawing shows a helical antenna 1 according to the present invention which has at least one and a half but not more than ten turns. The helical antenna 1 is mounted in a protective housing 2 which is permeable to electromagnetic waves in the UHF range. The protective housing 2 is preferably of impact-resistant plastics material.

The pitch of the helix 1 is denoted with s, the height with H and the diameter with D. It is essential for the UHF transmission range that these geometric dimensions s, H and D, as well as the total length of the stretched-out wire of the helical antenna 1 are very small as compared to the wave length.

The reduction of the height H and, thus, the reduction of the pitch s of the helical antenna 1, is carried out by compressing the resilient helix 1. For this purpose, a cap-shaped trimming disk 3 of high-grade HF insulating material is axially displaced by rotating it on a rod 4 which is provided with a fine thread. This makes it possible to carry out a continuous fine adjustment of the helical antenna 1. After the antenna has been tuned, the trimming disk 3 is fixed on the threaded rod 4, for example, by means of a drop of varnish or glue.

The compressed helix 1 rests with its lower end against the antenna base plate 5. The base plate 5 is a plastics material conductor plate with etched conductors and contact sleeves. The antenna rod 6 ensures the above-mentioned necessary distance from the coaxial plug connection 7 which, in turn, is fastened on the system base plate 8. The antenna rod 6 is electrically conductive and connects the central conductor of the coaxial line with the antenna base plate 5 by means of appropriate soldered connections. The beginning 9 of the helix is also connected by means of soldering to the antenna base plate 5. The antenna rod 6 is not part of a substantially shortened dipole antenna; rather, the antenna rod 6 merely acts as a UHF signal conductor.

Figure 2:
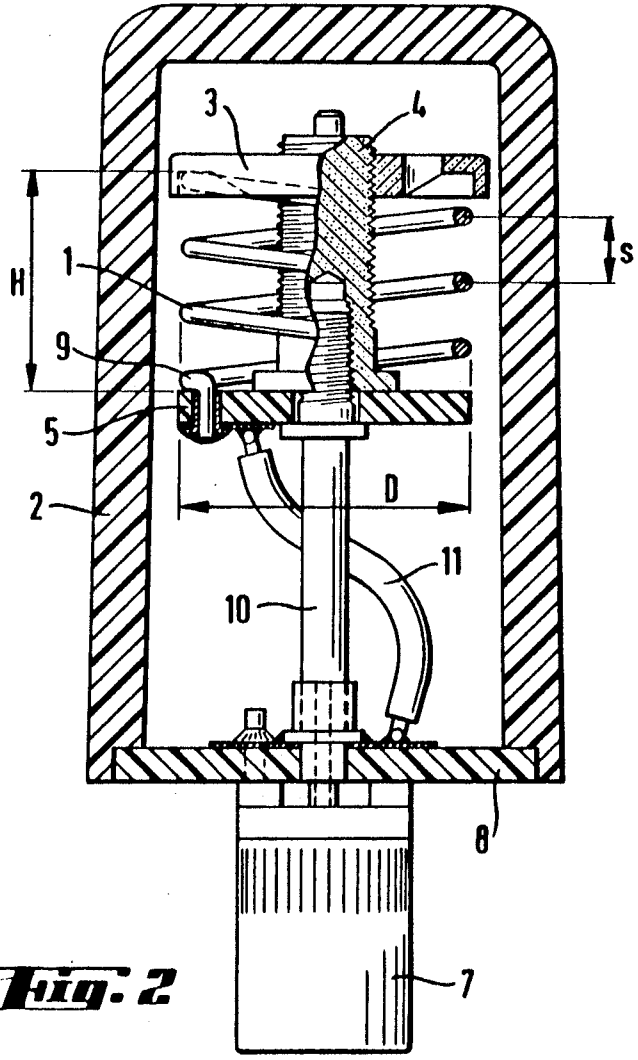
FIG. 2 is a sectional view of another embodiment of the helical antenna.

The embodiment of the helical antenna according to the present invention shown in FIG. 2 differs from the one shown in FIG. 1 only in that the antenna rod 10 is made of a highgrade UHF insulating material. In this case, the UHF signal is conducted to the antenna base plate through a piece of coaxial cable 11.

Figure 3:
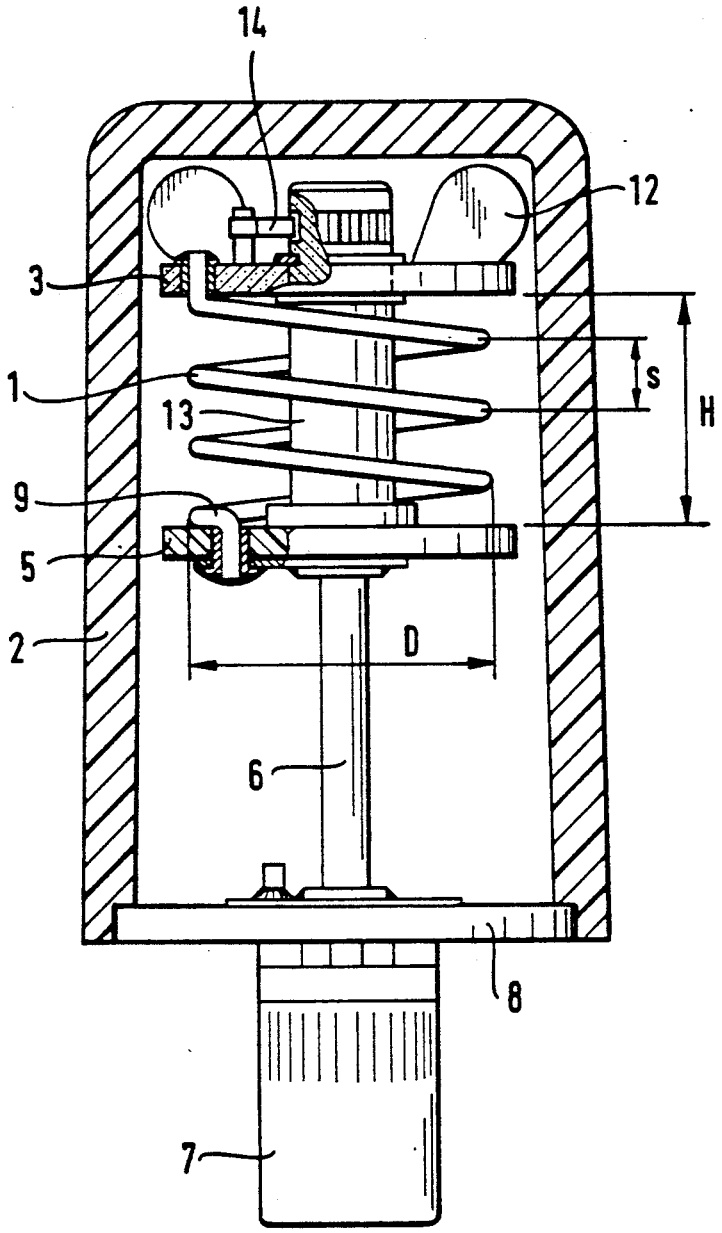
FIG. 3 is a cross-sectional view of yet another embodiment of the cross-sectional antenna.

FIG. 3 of the drawing shows an embodiment of the invention in which the diameter D of the helical antenna is changed for tuning to the transmitting frequency. The antenna helix 1 is fixedly connected by soldering in solder sleeves to the trimming disk 3 and to the antenna base plate 5. A wing nut 12 fixedly attached to the trimming disk 3 makes it possible to rotate the helical antenna 1 about axis 13. Depending on the direction of rotation, the diameter D is widened or narrowed transversely of the antenna axis. After tuning has been carried out, a detent 14 which engages in a toothed ring prevents the helix 1 from rotating back into the initial position.

The transmitter microphone has no significance for the present invention and, therefore, is not illustrated in the drawing. This is because it is assumed that it is apparent to the expert how the helical antenna 1 according to the invention is connected through the coaxial plug connection 7 to the shaft end of the microphone. Additional known means may be necessary for obtaining a detachable but fixable connection between the helical antenna and the microphone shaft.

While specific embodiments of the invention have been shown and described in detail to illustrate the inventive principles, it will be understood that the invention may be embodied otherwise without departing from such principles.

I claim:

1. A helical UHF transmitting and/or receiving antenna for electromagnetic waves in the frequency range of between 400 MHz and 1000 MHz, the waves having wave lengths, the antenna including a wire having the shape of a helix, the helix having an axis and a height, the helical wire being mounted within a closed housing which is permeable to HF radiation, a coaxial connector for supplying a UHF signal to an end of the helical wire, the helix having between one and a half of ten turns, the helical wire having a diameter, a height and a total length which are substantially smaller than the wave lengths, means for continuously changing the height of the helix by at most onethird of its height, the means for continuously changing the height of the helix comprising a rod having a fine thread extending in the axis of the helix, and a cap-shaped trimming disk having a fine thread and being rotatable on the rod, the trimming disk being movable on the rod in axial direction of the rod, further comprising a wing nut rotatably mounted on the rod and rigidly connected to the trimming disk, means for locking the trimming disk against torsion force of the helical wire, the helical wire having two ends, a base plate fixedly attached to one of the ends of the helical wire remote from the trimming disk, the base plate and the trimming disk having solder sleeves, the helical wire being attached by means of solder connections to the solder sleeve of the base plate and the trimming disk, wherein rotation of the wing nut results in continuous change of the diameter of the helical wire, wherein the trimming disk and the rod are of high-grade HF insulating material.

2. The helical antenna according to claim 1, comprising a rod-shaped insulator of high-grade HF insulating material for spacing the base plate from the coaxial connector and a piece of coaxial cable for supplying the UHF signal to the helical wires.

* * * * *